US007775321B2

(12) United States Patent
Hirukawa

(10) Patent No.: US 7,775,321 B2
(45) Date of Patent: Aug. 17, 2010

(54) MUFFLER STRUCTURE

(75) Inventor: Masayuki Hirukawa, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 168 days.

(21) Appl. No.: 12/200,273

(22) Filed: Aug. 28, 2008

(65) Prior Publication Data

US 2009/0057055 A1 Mar. 5, 2009

(30) Foreign Application Priority Data

Aug. 31, 2007 (JP) ..... 2007-226815

(51) Int. Cl.

| | |
|---|---|
| ***B21D 51/16*** | (2006.01) |
| ***F01N 13/18*** | (2010.01) |
| ***F01N 13/08*** | (2010.01) |
| *B21D 51/24* | (2006.01) |
| *B21D 51/26* | (2006.01) |
| *F01N 13/00* | (2010.01) |

(52) U.S. Cl. ..... 181/227; 181/243; 181/282; 29/890.08

(58) Field of Classification Search ..... 181/227, 181/228, 264, 265, 267, 268, 269, 272, 275, 181/281, 282, 243, 241; 29/890.08
See application file for complete search history.

(56) References Cited

U.S. PATENT DOCUMENTS

| | | | | |
|---|---|---|---|---|
| 2,187,431 | A * | 1/1940 | Powell | 29/890.08 |
| 3,248,791 | A * | 5/1966 | Powers | 29/460 |
| 3,507,357 | A * | 4/1970 | Blome | 181/282 |
| 4,333,545 | A * | 6/1982 | Roberts | 181/282 |
| 5,100,047 | A * | 3/1992 | Nakagawa et al. | 228/176 |
| 5,422,445 | A * | 6/1995 | Baird et al. | 181/282 |
| 5,718,045 | A * | 2/1998 | Tsukahara et al. | 29/890.08 |
| 6,038,769 | A * | 3/2000 | Bonny et al. | 29/890.08 |
| 6,223,434 | B1 * | 5/2001 | Morikawa | 29/890.08 |
| 6,247,552 | B1 * | 6/2001 | Kovar et al. | 181/240 |
| 6,405,827 | B1 * | 6/2002 | Church | 181/243 |
| 6,446,322 | B1 * | 9/2002 | Church | 29/513 |
| 6,575,267 | B1 * | 6/2003 | Stiles et al. | 181/282 |
| 7,293,628 | B2 * | 11/2007 | Takahashi | 181/227 |
| 7,549,508 | B2 * | 6/2009 | Okawara et al. | 181/227 |

FOREIGN PATENT DOCUMENTS

| | | |
|---|---|---|
| JP | 11-207425 A | 8/1999 |
| JP | 2007-23866 A | 2/2007 |

* cited by examiner

*Primary Examiner*—Edgardo San Martin
(74) *Attorney, Agent, or Firm*—Birch, Stewart, Kolasch & Birch, LLP

(57) ABSTRACT

A muffler structure in which a subassembly formed by fixing an inner cylinder and a separator is not welded to the outer cylinder in welding an overlapping portion of a sheet metal wrapped around the subassembly. A subassembly is formed by fixing an inner cylinder and a separator. An outer cylinder is formed by first wrapping a sheet metal around the subassembly and next welding an overlapping portion of the sheet metal. The subassembly is formed with a recess opposed to a welded portion of the outer cylinder.

20 Claims, 9 Drawing Sheets

MUFFLER STRUCTURE

CROSS-REFERENCE TO RELATED APPLICATIONS

The present application claims priority under 35 USC 119 to Japanese Patent Application No. 2007-226815 filed on Aug. 31, 2007 the entire contents of which are hereby incorporated by reference.

BACKGROUND OF TIE INVENTION

1. Field of the Invention

The present invention relates to a multichamber type muffler structure having a subassembly formed by fixing an inner cylinder and a separator and an outer cylinder formed by first wrapping a sheet metal around the subassembly and next welding an overlapping portion of the sheet metal.

2. Description of Background Art

In a conventional multichamber type muffler for a vehicle, an inner cylinder and a separator connected to an exhaust pipe or the like are supported in an outer cylinder so as to be movable in the axial direction of the outer cylinder. More specifically, the inner cylinder and the separator are not welded to the outer cylinder, in order to absorb a difference in the amount of extension between the outer cylinder and the inner cylinder. See, for example, Japanese Patent Laid-open No. 2007-23866. In this muffler, the outer cylinder is formed by first bending a piece of sheet metal into a cylindrical shape and next welding an overlapping portion near the opposite ends of the sheet metal. On the other hand, the inner cylinder and the separator are assembled to preliminarily form a subassembly. The subassembly is inserted into the outer cylinder, thus fabricating the muffler. However, it is difficult to remove welding residue on the inner surface of the outer cylinder prior to inserting the subassembly into the outer cylinder.

In another conventional multichamber type muffler for a vehicle, a separator and a pipe are assembled to form a subassembly, and an outer cylinder is formed by first wrapping a sheet metal around this subassembly and next welding an overlapping portion of the sheet metal. See, for example, Japanese Patent Laid-open No. Hei 11-207425.

In a muffler structure having an inner cylinder, an outer cylinder, and a separator having an outer diameter substantially equal to the inner diameter of the outer cylinder, wherein the inner cylinder and the separator are assembled to form a subassembly and the outer cylinder is formed by first wrapping a piece of sheet metal around the subassembly and next welding an overlapping portion of the sheet metal, there arises a problem such that the outer cylinder may be welded to the outer circumferential portion of the separator by welding the overlapping portion of the sheet metal. Accordingly, the separator cannot be moved in the outer cylinder in the case wherein a thermal expansion occurs in the muffler.

SUMMARY AND OBJECTS OF THE INVENTION

It is accordingly an object of the present invention to provide a muffler structure in which the subassembly is not welded to the outer cylinder in welding the overlapping portion of the sheet metal wrapped around the subassembly.

In accordance with an embodiment of the present invention, there is provided a muffler structure including a subassembly formed by fixing an inner cylinder and a separator. An outer cylinder is provided for supporting the subassembly so as to accommodate the subassembly. The outer cylinder is formed by first wrapping a piece of sheet metal around the subassembly and next welding an overlapping portion of the sheet metal with the subassembly being formed with a recess opposed to a welded portion of the outer cylinder.

According to an embodiment of the present invention, the outer cylinder is formed by first wrapping the sheet metal around the subassembly of the inner cylinder and the separator and next welding the overlapping portion of the sheet metal, and the subassembly is formed with the recess opposed to the welded portion of the outer cylinder. Accordingly, the welded portion of the outer cylinder is spaced apart from the recess of the subassembly, so that the subassembly is prevented from being welded to the outer cylinder in welding the overlapping portion of the sheet metal.

Further, the outer cylinder is formed by first wrapping the sheet metal around the subassembly and next welding the overlapping portion of the sheet metal. Accordingly, a step of inserting the subassembly into the outer cylinder as in the prior art can be eliminated and it is therefore not necessary to remove a weld residue on the inner surface of the outer cylinder prior to insertion of the subassembly into the outer cylinder.

According to an embodiment of the present invention, the separator has an outer diameter substantially equal to the inner diameter of the outer cylinder, and the recess is formed on the outer circumferential surface of the separator. With this configuration, the welded portion of the outer cylinder is spaced apart from the recess formed on the outer circumferential surface of the separator having an outer diameter substantially equal to the inner diameter of the outer cylinder, so that the separator is prevented from being welded to the outer cylinder in welding the overlapping portion of the sheet metal.

According to an embodiment of the present invention, the inner cylinder has a flange portion having an outer diameter substantially equal to the inner diameter of the outer cylinder, and the recess is formed on the outer circumferential surface of the flange portion. With this configuration, the welded portion of the outer cylinder is spaced apart from the recess formed on the outer circumferential surface of the flange portion having an outer diameter substantially equal to the inner diameter of the outer cylinder, so that the inner cylinder is prevented from being welded to the outer cylinder in welding the overlapping portion of the sheet metal.

According to an embodiment of the present invention, a sound insulating material is provided between the outer cylinder and the inner cylinder, and the space defined by the recess and the outer cylinder is filled with a plug member. With this configuration, the space defined by the recess of the subassembly and the outer cylinder is filled with the plug member. Accordingly, the sound insulating material provided between the outer cylinder and the inner cylinder is prevented from scattering from the recess.

According to an embodiment of the present invention, the outer cylinder is formed by first wrapping the sheet metal around the subassembly of the inner cylinder and the separator and next welding the overlapping portion of the sheet metal, and the subassembly is formed with the recess opposed to the welded portion of the outer cylinder. Accordingly, the subassembly is prevented from being welded to the outer cylinder in welding the overlapping portion of the sheet metal.

Further, the separator has an outer diameter substantially equal to the inner diameter of the outer cylinder, and the recess is formed on the outer circumferential surface of the separator. Accordingly, the separator is prevented from being welded to the outer cylinder in welding the overlapping portion of the sheet metal.

Further, in the case that the inner cylinder has a flange portion having an outer diameter substantially equal to the inner diameter of the outer cylinder and that the recess is formed on the outer circumferential surface of the flange portion, the inner cylinder is prevented from being welded to the outer cylinder in welding the overlapping portion of the sheet metal.

Further, the sound insulating material is provided between the outer cylinder and the inner cylinder, and the space defined by the recess and the outer cylinder is filled with the plug member. Accordingly, scattering of the sound insulating material from the recess can be prevented by the plug member.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
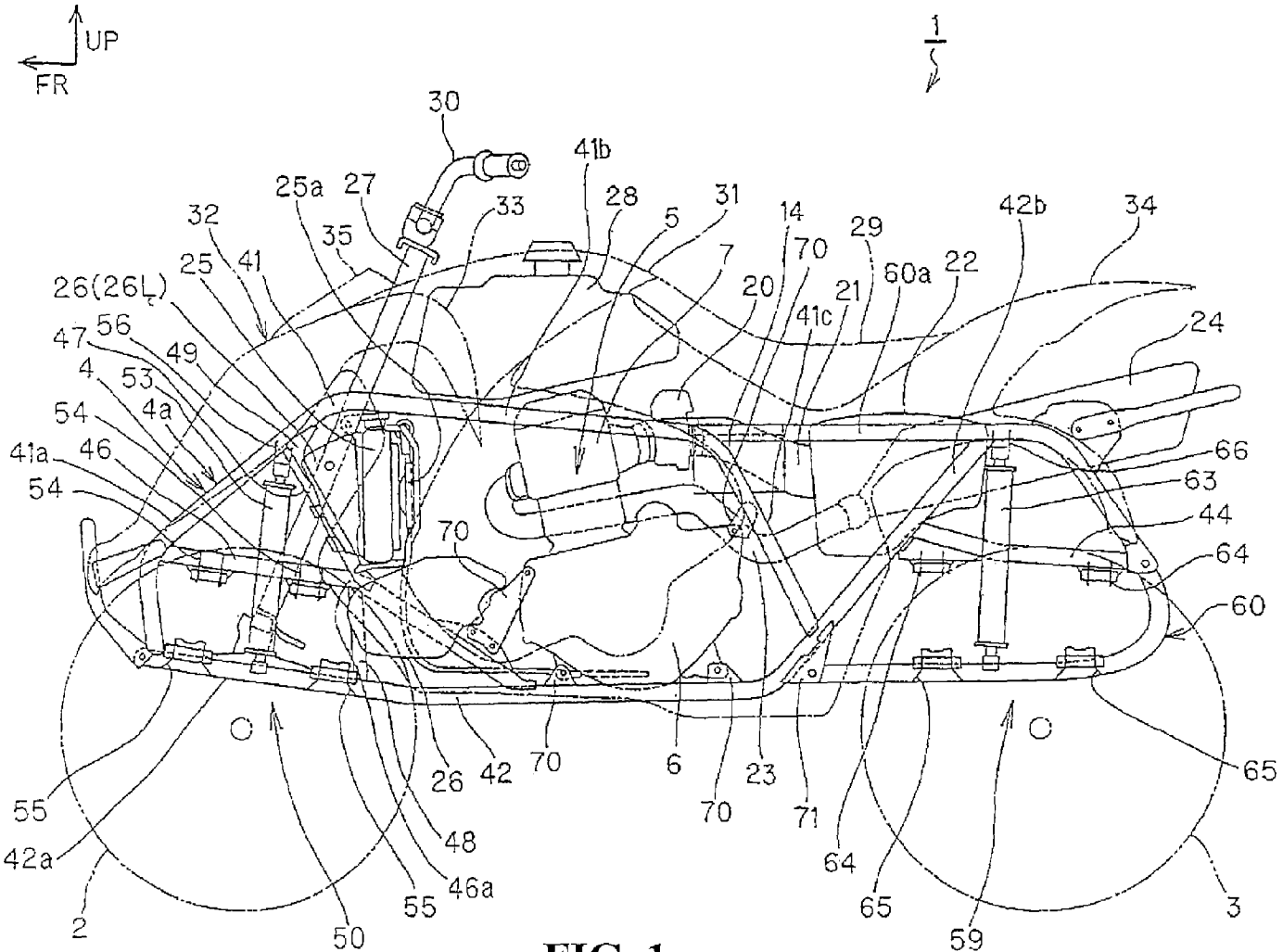
FIG. 1 is a side view of a saddle seat type vehicle according to a first preferred embodiment of the present invention.

Some preferred embodiments of the present invention will now be described with reference to the attached drawings. In the following description, the terms of "front," "rear," "right," "left," "upper" and "lower" refer to the directions with respect to the vehicle body. Further, in the drawings, the arrow FR denotes the front side of the vehicle body, the arrow R denotes the right side of the vehicle body, and the arrow UP denotes the upper side of the vehicle body.

Figure 2:
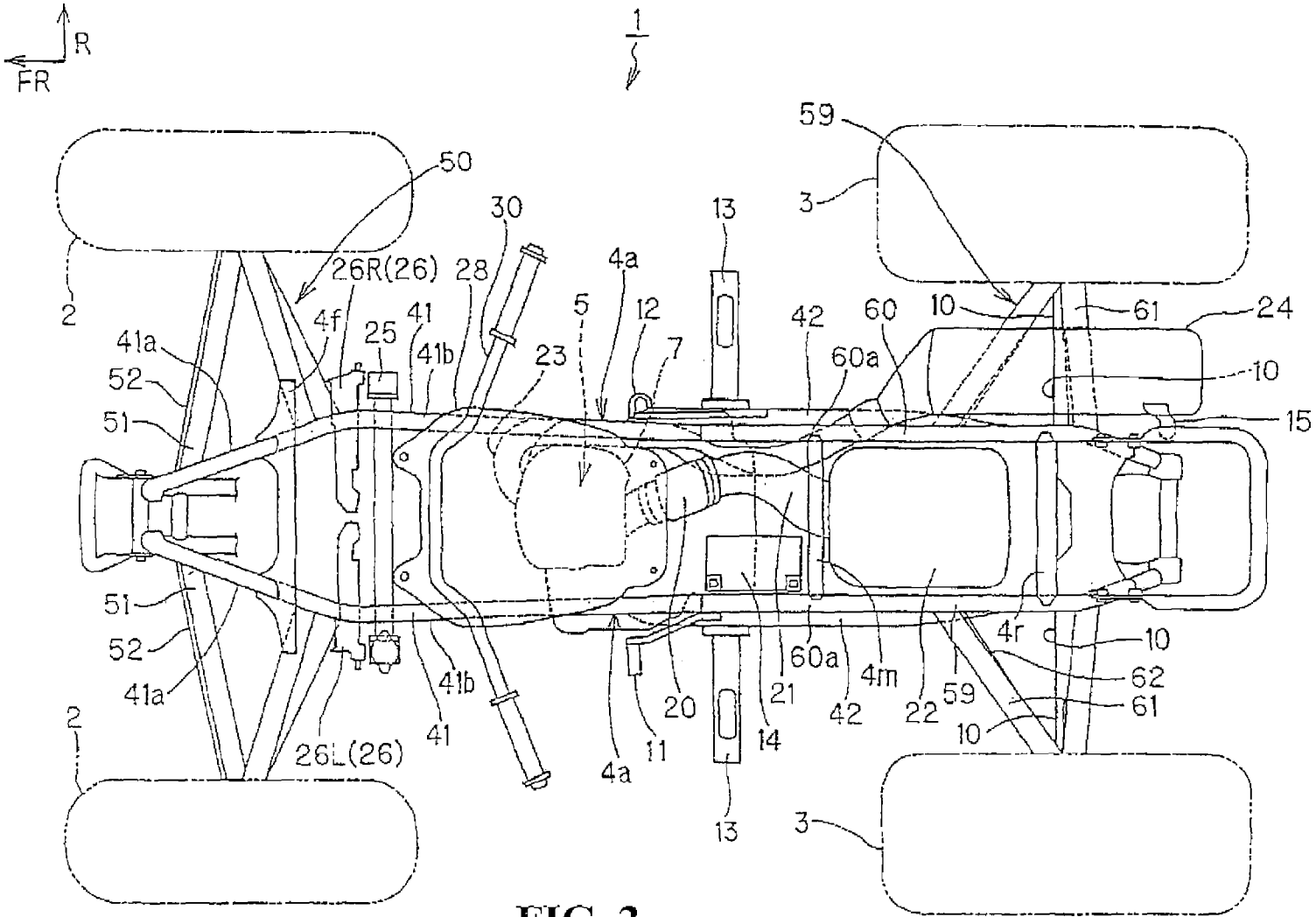
FIG. 2 is a plan view of the vehicle shown in FIG. 1.

FIG. 1 is a side view of a saddle seat type vehicle 1 according to a first preferred embodiment of the present invention, and FIG. 2 is a plan view of the vehicle 1 shown in FIG. 1.

The vehicle 1 is a four-wheel vehicle classified as an ATV (All Terrain Vehicle), which has a vehicle body reduced in size and weight. A pair of right and left front wheels 2 each having a relatively large diameter are provided at the front portion of the vehicle body. A pair of right and left rear wheels 3 each having a relatively large diameter are provided at the rear portion of the vehicle body. Thus, a sufficient ground clearance is ensured to improve the running through performance on a rough road.

As shown in FIG. 1, the vehicle 1 has a body frame 4. Each of the right and left front wheels 2 is supported through a front suspension 50 to the front portion of the body frame 4. Each of the right and left rear wheels 3 is supported through a rear suspension 59 to the rear portion of the body frame 4.

An engine (water cooled engine) 5 is supported through a plurality of engine mounts 70 to the body frame 4 at a substantially central portion thereof. The engine 5 has a cylinder portion 7. A throttle body 20 is connected to the rear portion of the cylinder portion 7. An air cleaner case 22 is connected through a connecting tube 21 to the rear portion of the throttle body 20. Thus, the throttle body 20, the connecting tube 21, and the air cleaner case 22 constitute an intake system for the engine 5. On the other hand, an exhaust pipe 23 is connected to the front portion of the cylinder portion 7 of the engine 5. As shown in FIG. 2, the exhaust pipe 23 first extends to the front from the front portion of the cylinder portion 7, next bends to the right to extend to the rear along the right side of the cylinder portion 7, and is finally connected to a muffler 24 located at the rear portion of the vehicle body. Thus, the exhaust pipe 23 and the muffler 24 constitute an exhaust system for the engine 5.

As shown in FIG. 2, the vehicle 1 includes a shift pedal 11, a brake pedal 12, a pair of right and left footrests 13, and a battery 14.

As shown in FIG. 1, a radiator 25 for cooling the engine 5 is provided on the front side of the engine 5. The radiator 25 is connected through cooling water pipes formed of rubber to the engine 5. Cooling water is supplied from the engine 5 to the radiator 25 to be cooled by an air flow received by the radiator 25 from the front side of the vehicle. The cooling water thus cooled is returned to the engine 5. A cooling fan **25*a* is provided behind the radiator 25 to forcibly draw the outside air through the radiator 25, thereby cooling the cooling water in the radiator 25. A reservoir tank (not shown) for storing the cooling water is provided below the radiator 25 (e.g., below the left side of the radiator 25). The reservoir tank is connected through a rubber tube to the radiator 25**.

The engine 5 includes a crankcase 6 for supporting a crankshaft. The cylinder portion 7 is connected to the upper end of the crankcase 6. The crankcase 6 serves also as a transmission case for accommodating a transmission. The crankcase 6 has an output shaft connected to the transmission in the crankcase 6. The rotation of the output shaft is transmitted through a chain drive mechanism (not shown) to a final gear case (not shown) provided at the rear portion of the body frame 4, and is further transmitted through a pair of right and left drive shafts 10 (see FIG. 2) extending from the final gear case to the right and left rear wheels 3, thus rotationally driving the rear wheels 3.

As shown in FIG. 1, the upper portion of the body frame 4 is provided with a steering shaft 27 for steering the front wheels 2. A fuel tank 28 and a saddle seat 29 are arranged in this order from the front side of the vehicle. The steering shaft 27, the fuel tank 28, and the saddle seat 29 are located at a central position in the lateral direction of the vehicle. A handle bar 30 is mounted on the upper end portion of the steering shaft 27 so as to be located on the front upper side of the fuel tank 28. The lower end portion of the steering shaft 27 is connected to a steering mechanism (not shown), wherein the front wheels 2 are steered through the steering mechanism by operating the bar handle 30.

The fuel tank 28 is located above the engine 5, and fuel stored in the fuel tank 28 is supplied through a fuel pump (not shown) to an injector (not shown) provided in the throttle body 20. The fuel is injected into the engine 5 by the injector.

The saddle seat 29 extends in the longitudinal direction of the vehicle body. The saddle seat 29 is fixed to a tank cover 31 which covers the upper side of the fuel tank 28 with the front end thereof. The saddle seat 29 is also fixed to the body frame 4.

A body cover 32 for covering the vehicle body is mounted on the body frame 4. A front fender 33 for covering each front wheel 2 from the upper side to the rear side thereof is mounted on the body frame 4. A rear fender 34 for covering each rear wheel 3 from the front side to the upper side thereof is mounted on the body frame 4. All of the body cover 32, each front fender 33, and each rear fender 34 are formed of resin. The body cover 32 includes a top cover 35 for covering the front portion of the vehicle body and a pair of right and left side covers (not shown) for covering the right and left sides of the front portion of the vehicle body.

As shown in FIG. 2, the body frame 4 has a pair of right and left main frames 4*a* extending substantially in the longitudinal direction of the vehicle body and a pair of right and left subframes 60 respectively connected to the rear portions of the right and left main frames 4*a*. Each main frame 4*a* is composed mainly of an upper pipe 41 and a lower pipe 42 connected to each other by welding or the like, thereby forming a closed loop structure. The pipes 41 and 42 are provided by a plurality of kinds of steel members (cylindrical pipe frames or round pipe frames). The right and left main frames 4*a* are connected to each other through a plurality of cross members 4*f*, 4*m*, and 4*r*, thus forming a box structure elongated in the longitudinal direction of the vehicle body at the laterally central position of the vehicle body.

As shown in FIGS. 1 and 2, each upper pipe 41 is formed by bending a single steel pipe, and it is composed of a front inclined portion 41*a* extending to the rear from its front end so as to be inclined steeply upward, an intermediate portion 41*b* extending to the rear from the rear end of the front inclined portion 41*a* so as to be inclined gently downwardly, and a rear inclined portion 41*c* extending to the rear from the rear end of the intermediate portion 41*b* so as to be inclined steeply downward. As shown in FIG. 2, the distance between the right and left front inclined portions 41*a* is gradually increased toward the rear side of the vehicle, and the distance between the right and left intermediate portions 41*b* is substantially constant. Further, the distance between the right and left rear inclined portions 41*c* is also substantially constant.

The right and left subframes 60 are respectively connected at their front upper ends to the right and left upper pipes 41 at the bent portions between the respective intermediate portions 41*b* and the respective rear inclined portions 41*c*, and extend substantially horizontally toward the rear side of the vehicle body as shown by portions 60*a*. At the rear portion of the vehicle body, the subframes 60 are bent downward and further bent to the front so as to form a substantially U-shaped configuration as viewed in side elevation. The front lower ends of the right and left subframes 60 are respectively connected to the right and left lower pipes 42.

The horizontal portions 60*a* of the right and left subframes 60 serve also as seat rails, and the cross member 4*m* serving also as a support member for supporting the rear end of the seat 29 is located so as to connect the right and left horizontal portions 60*a*.

As shown in FIG. 1, each lower pipe 42 is formed by bending a single steel pipe that extends below the corresponding upper pipe 41 in the longitudinal direction of the vehicle body. Each lower pipe 42 is composed of a horizontal portion 42*a* connected at its front end to the front inclined portion 41*a* of the corresponding upper pipe 41 and extends substantially horizontally toward the rear side and a rear inclined portion 42*b* extending to the rear from the rear end of the horizontal portion 42*a* so as to be inclined steeply upwardly. The rear end of the rear inclined portion 42*b* of each lower pipe 42 is connected to the corresponding subframe 60.

Each subframe 60 is connected through a bracket 71 to the corresponding lower pipe 42 at the bent portion between the horizontal portion 42*a* and the rear inclined portion 42*b*. The final gear case (not shown) for the rear wheels 3 is supported between the right and left subframes 60.

A pair of right and left rear subframes 44 are respectively provided so as to connect the right and left subframes 60 and the rear inclined portions 42*b* of the right and left lower pipes 42. Each rear subframe 44 and each subframe 60 are provided with upper arm supporting portions 64 for supporting upper arms 61 (see FIG. 2), lower arm supporting portions 65 for supporting lower arms 62 (see FIG. 2), and a shock absorber supporting portion 66 for supporting a rear shock absorber 63 (see FIG. 1). The upper arms 61, the lower arms 62, and the rear shock absorber 63 constitute the rear suspension 59 for each rear wheel 3. Thus, the components 61, 62, and 63 of the right and left rear suspensions 59 are supported by the right and left rear subframes 44 and the right and left subframes 60, respectively.

As shown in FIG. 1, a pair of right and left front frames 46 are respectively provided so as to connect the front inclined portions 41*a* of the right and left upper pipes 41 and the horizontal portions 42*a* of the right and left lower pipes 42 and to extend to the rear from near the front ends of the right and left upper pipes 41. Each front frame 46, the horizontal portion 42*a* of each lower pipe 42, and the front inclined portion 41*a* of each upper pipe 41 are provided with upper arm supporting portions 54 for supporting upper arms 51 (see FIG. 2), lower arm supporting portions 55 for supporting lower arms 52 (see FIG. 2), and a shock absorber supporting portion 56 for supporting a front shock absorber 53 (see FIG. 1). The upper arms 51, the lower arms 52, and the front shock absorber 53 constitute the front suspension 50 for each front wheel 2. Thus, these components 51, 52, and 53 of the right and left front suspensions 50 are supported by the right and left front frames 46, the right and left lower pipes 42, and the right and left upper pipes 41. The right and left shock absorber supporting portions 56 are formed on the cross member 4*f* located so as to connect the front inclined portions 41*a* of the right and left upper pipes 41.

Each front frame 46 is bent at a bent portion 46*a* behind the upper arm supporting portion 54 and extends to be connected to the horizontal portion 42*a* of the corresponding lower pipe 42 so as to be inclined downwardly. A pair of right and left down tubes 47 are respectively provided so as to connect the bent portions 46*a* of the right and left front frames 46 and the front inclined portions 41*a* of the right and left upper pipes 41. More specifically, the right and left down tubes 47 extend obliquely downwardly from the right and left upper pipes 41 to the right and left front frames 46, respectively. Similarly, a pair of right and left front lower frames 48 are respectively provided to connect the bent portions 46*a* of the right and left front frames 46 and the horizontal portions 42*a* of the right and left lower pipes 42. More specifically, the right and left front lower frames 48 extend upward from the right and left lower pipes 42 to the right and left front frames 46, respectively. Accordingly, a truss structure is formed by the members 46, 47, and 48 to increase the frame rigidity at the front portion of the body frame 4. As shown in FIG. 1, each down tube 47 and the corresponding upper pipe 41 are connected through a bracket 49 as a substantially triangular plate member. By using the bracket 49, the connection area between the down tube 47 and the upper pipe 41 can be increased to thereby increase the connection strength therebetween.

A radiator grille 26 is mounted on the right and left down tubes 47. The radiator grille 26 is composed of a pair of right and left radiator grilles 26R and 26L arranged symmetrically as viewed from the front side of the vehicle. More specifically, the right radiator grille 26R is located so as to cover the right half of the front surface of the radiator 25, and the left radiator grille 26L is located so as to cover the left half of the front surface of the radiator 25.

As shown in FIG. 2, the muffler 24 is located on the right side of the rear portion of the vehicle body. The muffler 24 is provided with a first stay (not shown) and a second stay 15, while the right rear subframe 44 and the right subframe 60 are respectively provided with muffler mounting brackets (not shown). The muffler 24 is bolted through the first stay and the second stay 15 to the muffler mounting brackets.

Figure 3:
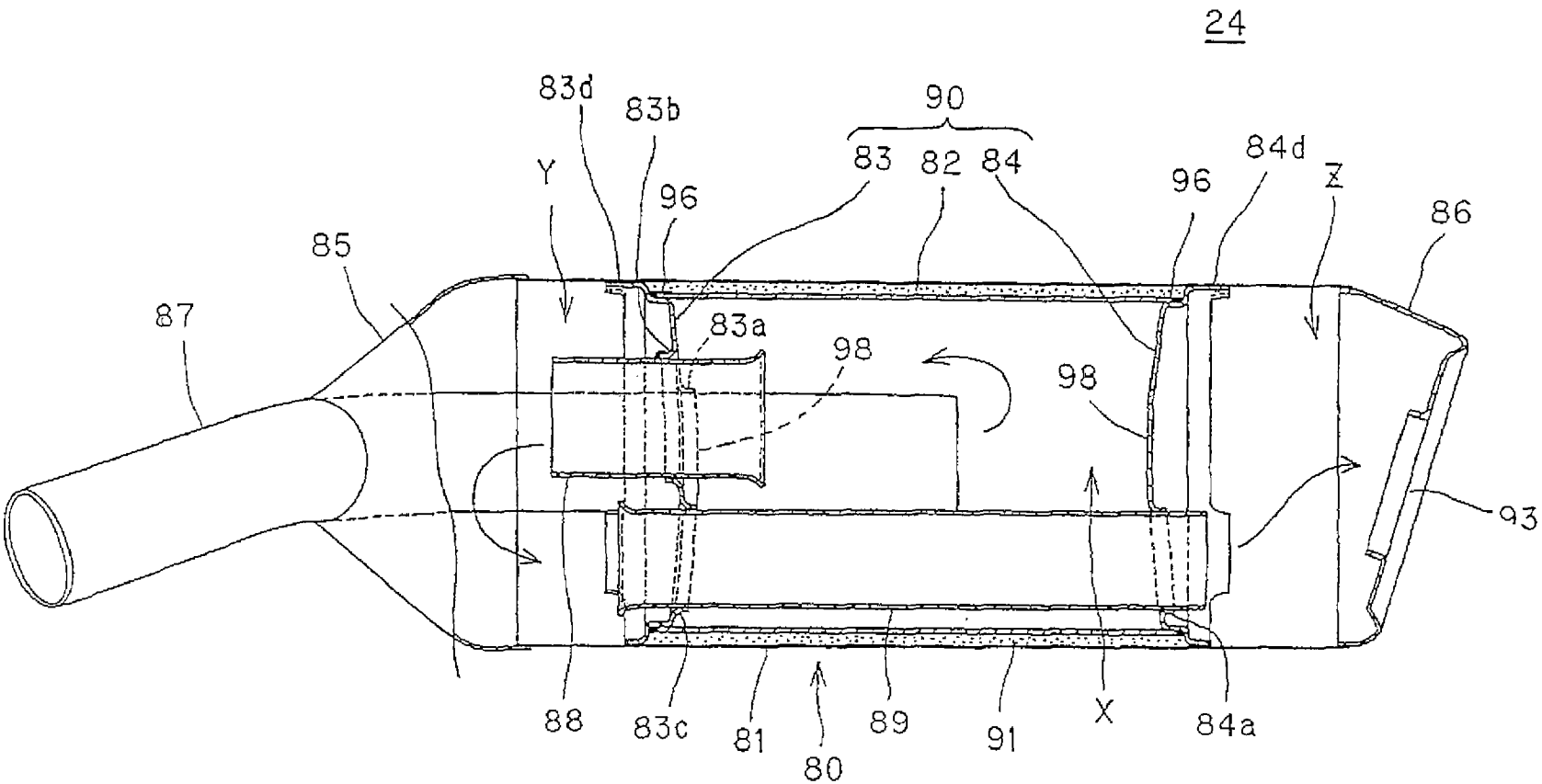
FIG. 3 is a partially sectional side view of a muffler according to the first preferred embodiment.

FIG. 3 is a partially sectional side view of the muffler 24.

The muffler 24 includes an outer cylinder 80, an inner cylinder 82 accommodated in the outer cylinder 80, a first separator 83 mounted to the front end of the inner cylinder 82 for separating the inside space of the muffler 24, and a second separator 84 mounted to the rear end of the inner cylinder 82 for separating the inside space of the muffler 24. The first and second separators 83 and 84 are welded to the opposite ends of the inner cylinder 82. A front cap 85 is welded to the front end of the outer cylinder 80 to thereby close the front end of the outer cylinder 80, and an end cap 86 is welded to the rear end of the outer cylinder 80 to thereby close the rear end of the outer cylinder 80.

The outer cylinder 80 has a substantially circular cross section, and the inner cylinder 82 accommodated in the outer cylinder 80 also has a substantially circular cross section. The first and second separators 83 and 84 accommodated in the outer cylinder 80 are also substantially circular as viewed in elevation. The inner cylinder 82 is obtained by forming a punching metal (perforated metal) into a cylindrical shape.

The inside space of the muffler 24 is separated by the first separator 83 and the second separator 84 to define a first expansion chamber X, a second expansion chamber Y, and a third expansion chamber Z. The first expansion chamber X is defined between the first separator 83 and the second separator 84 in the central region of the muffler 24. The second expansion chamber Y is defined between the front cap 85 and the first separator 83 in the front region of the muffler 24. The third expansion chamber Z is defined between the second separator 84 and the end cap 86 in the rear region of the muffler 24.

A first exhaust pipe 87 is mounted to the front cap 85 so as to be inserted through a hole 83*a* of the first separator 83 to communicate with the first expansion chamber X. The first exhaust pipe 87 is connected to the exhaust pipe 23 to introduce the exhaust gas from the engine 5 into the muffler 24. The first exhaust pipe 87 is welded to the front cap 85, but it is not welded to the first separator 83 at the hole 83*a*. That is, the first exhaust pipe 87 is unfixedly connected to the first separator 83 at the hole 83*a*.

The first separator 83 is formed with a hole 83*b* separate from the hole 83*a* for insertion of the first exhaust pipe 87. A second exhaust pipe 88 for making the communication between the first expansion chamber X and the second expansion chamber Y is mounted to the first separator 83 so as to be inserted through the hole 83*b* of the first separator 83. The second exhaust pipe 88 is welded to the first separator 83 at the hole 83*b*.

The first separator 83 is further formed with a hole 83*c* separate from the holes 83*a* and 83*b*. A third exhaust pipe 89 for making the communication between the second expansion chamber Y and the third expansion chamber Z is mounted to the first separator 83 and the second separator 84 so as to be inserted through the hole 83*c* of the first separator 83 and a hole 84*a* of the second separator 84. The third exhaust pipe 89 is press-fitted with the hole 83*c* of the first separator 83, but it is not welded to the second separator 84 at the hole 84*a*. The end cap 86 is formed with an exhaust hole 93 exposed to the outside air. A spark arrester (not shown) for preventing the emission of soot contained in the exhaust gas is mounted at the exhaust hole 93.

With this structure, the exhaust gas from the engine 5 is first passed through the first exhaust pipe 87 to enter the first expansion chamber X. Thereafter, the direction of flow of the exhaust gas is reversed as shown by the arrow in FIG. 3 and the exhaust gas is passed through the second exhaust pipe 88 to enter the second expansion chamber Y. Thereafter, the direction of flow of the exhaust gas is reversed again as shown by the arrow in FIG. 3 and the exhaust gas is passed through the third exhaust pipe 89 to enter the third expansion chamber Z. Finally, the exhaust gas is discharged from the exhaust hole 93 of the end cap 86. In this manner, the exhaust gas is passed through the first expansion chamber X, the second expansion chamber Y, and the third expansion chamber Z to expand in each expansion chamber. Further, the direction of flow of the exhaust gas is reversed a plurality of times in the muffler 24 to thereby increase the length of an exhaust passage. That is, a so-called three-pass structure is adopted in the muffler 24, so that the pressure of the exhaust gas in the muffler 24 can be reduced and exhaust noise can therefore be reduced.

The muffler 24 is manufactured in the following manner.

First, the first separator 83 and the second separator 84 are welded to the opposite ends of the inner cylinder 82 to thereby obtain a subassembly 90 as shown in FIG. 3. Thereafter, sheet metal 81 is wrapped around the outer circumferential portions of the first and second separators 83 and 84 of the subassembly 90 to thereby form the substantially cylindrical outer cylinder 80 surrounding the subassembly 90. In this step, an overlapping portion 100 (see FIG. 7) of the sheet metal 81 forming the outer cylinder 80 is welded to form the substantially cylindrical shape of the outer cylinder 80 in the condition where the subassembly 90 is surrounded by the outer cylinder 80. Thereafter, the front cap 85 having the first exhaust pipe 87 is welded to the front end of the outer cylinder 80, and the end cap 86 is welded to the rear end of the outer cylinder 80, thus completing the muffler 24.

Figure 6:
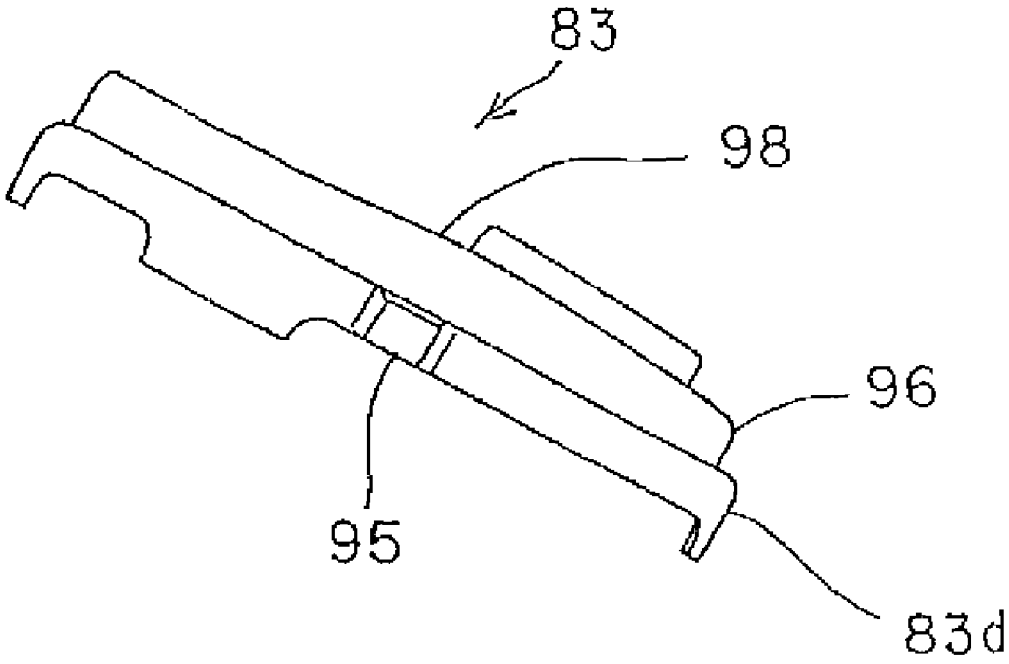
FIG. 6 is a view taken in the direction of an arrow B in FIG. 5.

As shown in FIGS. 3 and 6, the first separator 83 is a substantially pan-shaped member having a large-diameter portion 83*d*, a small-diameter portion 96, and a bottom portion 98. Similarly, the second separator 84 is a substantially pan-shaped member having a large-diameter portion 84*d*, a small-diameter portion 96, and a bottom portion 98. The outer diameter of the large-diameter portion 83*d* of the first separator 83 is substantially the same as the inner diameter of the outer cylinder 80, and the outer diameter of the large-diameter portion 84*d* of the second separator 84 is substantially the same as the inner diameter of the outer cylinder 80. The small-diameter portion 96 of the first separator 83 is formed between the large-diameter portion 83*d* and the substantially dish-shaped bottom portion 98. Similarly, the small-diameter portion 96 of the second separator 84 is formed between the large-diameter portion 84*d* and the substantially dish-shaped bottom portion 98. The outer diameter of each small-diameter portion 96 is substantially the same as the inner diameter of the inner cylinder 82. The subassembly 90 is formed in such a manner that the small-diameter portions 96 of the first and second separators 83 and 84 are fitted to the opposite ends of the inner cylinder 82 and that the bottom portions 98 of the first and second separators 83 and 84 are opposed to each other. In this condition, the small-diameter portions 96 are welded to the inner cylinder 82.

The subassembly 90 is accommodated in the outer cylinder 80. The first separator 83 of the subassembly 90 is mounted inside the outer cylinder 80 in such a manner that the large-diameter portion 83*d* of the first separator 83 is fitted with the inner surface of the outer cylinder 80. On the other hand, the second separator 84 of the subassembly 90 is mounted inside the outer cylinder 80 in such a manner that the large-diameter portion 84*d* of the second separator 84 is fitted with the inner surface of the outer cylinder 80 and is next plug-welded from the outside of the outer cylinder 80.

Preferably, the second exhaust pipe 88 and the third exhaust pipe 89 are preliminarily mounted to the subassembly 90, so as to facilitate the manufacturing of the muffler 24. Further, since the third exhaust pipe 89 is inserted through the first and second separators 83 and 84, it is preferable to preliminarily mount the third exhaust pipe 89 to the subassembly 90, thereby facilitating the alignment of the first and second separators 83 and 84.

A sound insulating material 91 such as glass wool is filled in the annular space defined between the outer cylinder 80 and the inner cylinder 82, thereby enhancing the noise suppression performance of the muffler 24. Prior to wrapping the sheet metal 81 around the subassembly 90, the sound insulating material 91 is provided on the subassembly 90.

Figure 4:
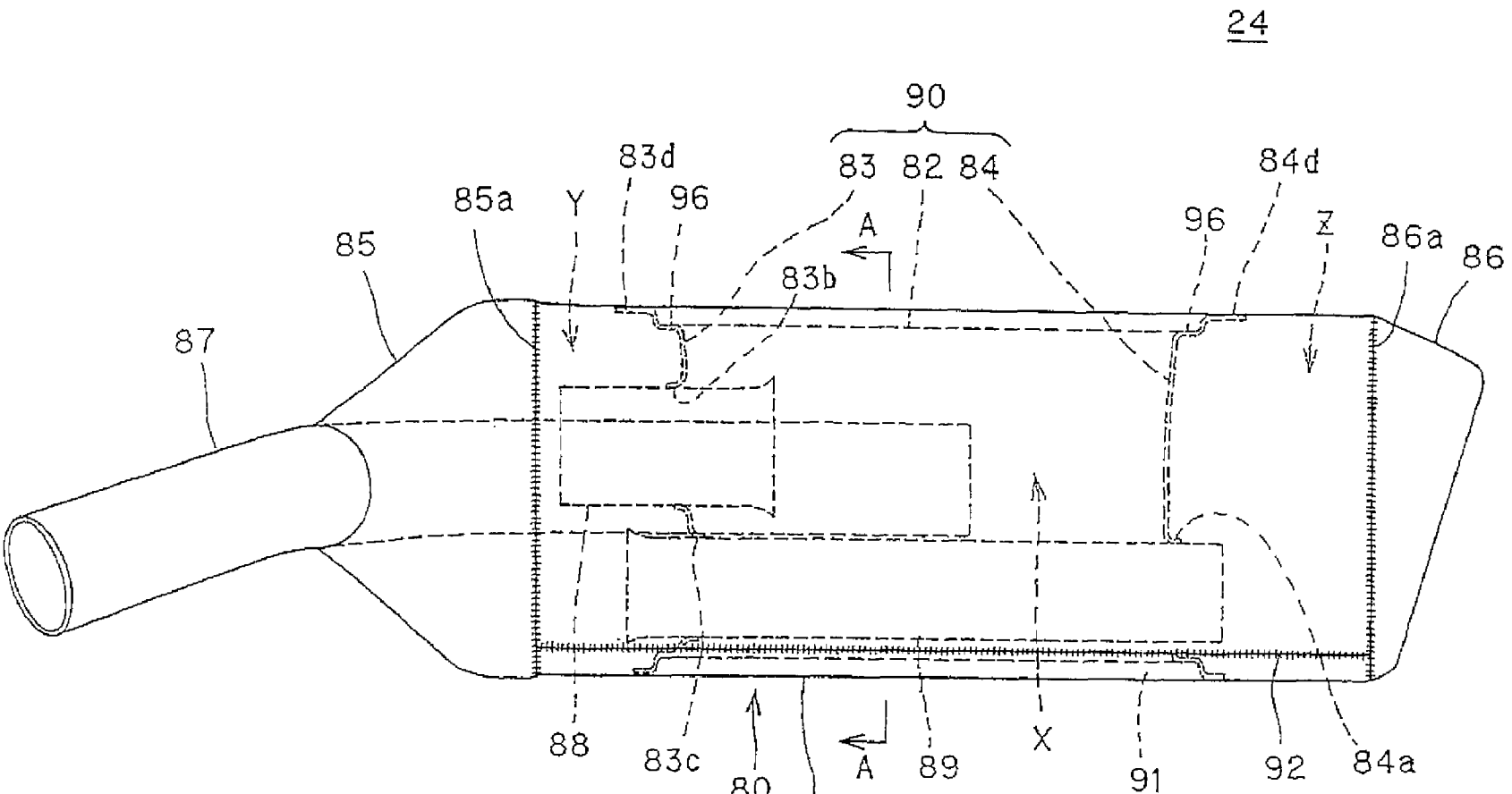
FIG. 4 is a side view of the muffler.

FIG. 4 is a side view of the muffler 24.

As described above, the substantially cylindrical outer cylinder 80 is formed by first wrapping the sheet metal 81 around the subassembly 90 and next welding the overlapping portion 100 (see FIG. 7) of the sheet metal 81. Accordingly, the outer cylinder 80 has a welded portion 92 extending substantially parallel to the axial direction of the outer cylinder 80 over the length of the overlapping portion 100. Further, the front cap 85 and the outer cylinder 80 are welded to each other as shown by a welded portion 85*a* extending over the circumference of the outer cylinder 80. Similarly, the end cap 86 and the outer cylinder 80 are welded to each other as shown by a welded portion 86*a* extending over the circumference of the outer cylinder 80.

Figure 5:
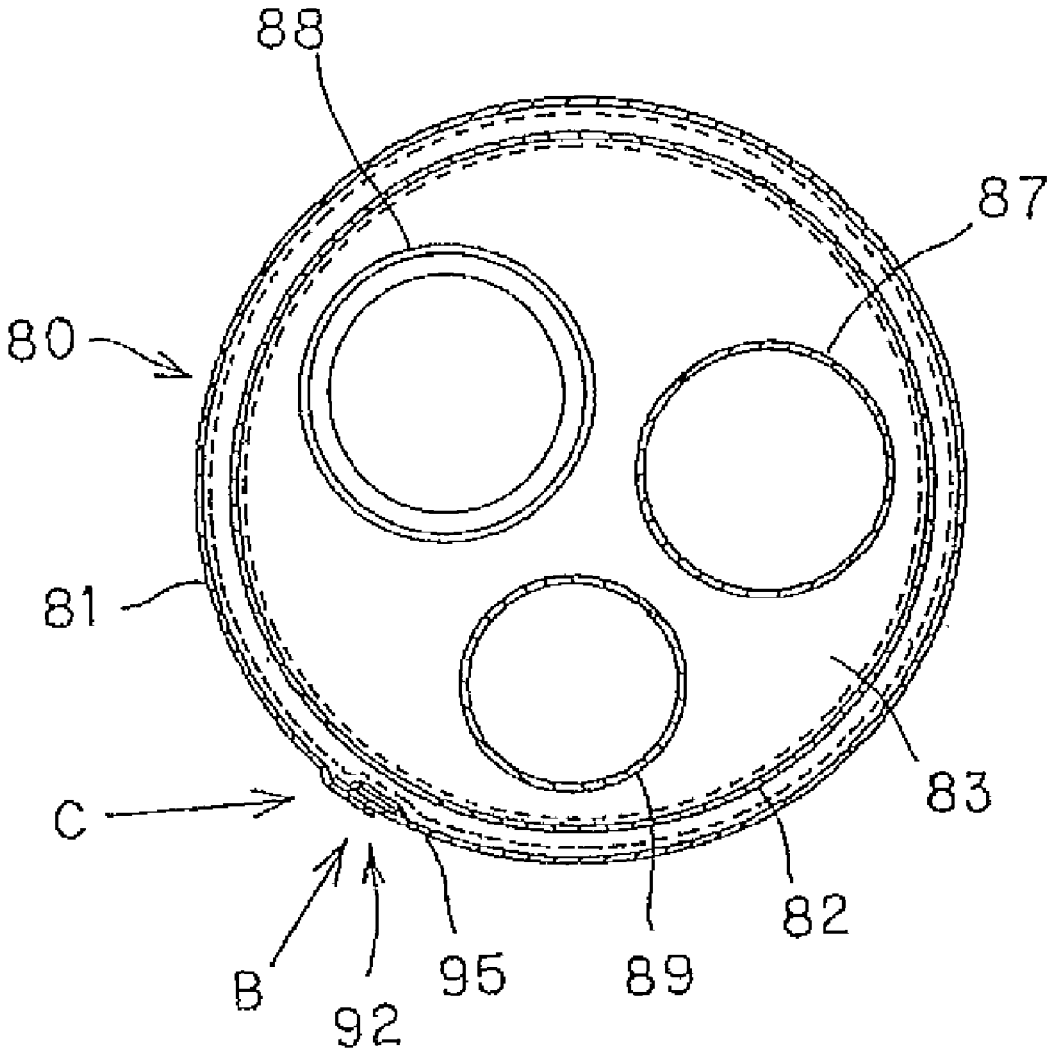
FIG. 5 is a cross section taken along the line A-A in FIG. 4.

FIG. 5 is a cross section taken along the line A-A in FIG. 4.

FIG. 5 illustrates a cross section C of the welded portion 92. The first separator 83 is formed with a recess 95 at a position radially inside of the welded portion 92. That is, the recess 95 is formed on the outer circumferential surface of the large-diameter portion 83*d* of the first separator 83 so as to face the welded portion 92 of the outer cylinder 80.

FIG. 6 shows the first separator 83 as viewed in the direction of an arrow B in FIG. 5.

As shown in FIG. 6, the recess 95 is formed on the outer circumferential surface of the large-diameter portion 83*d* of the first separator 83, and the bottom surface of the recess 95 is substantially flat.

Figure 7:
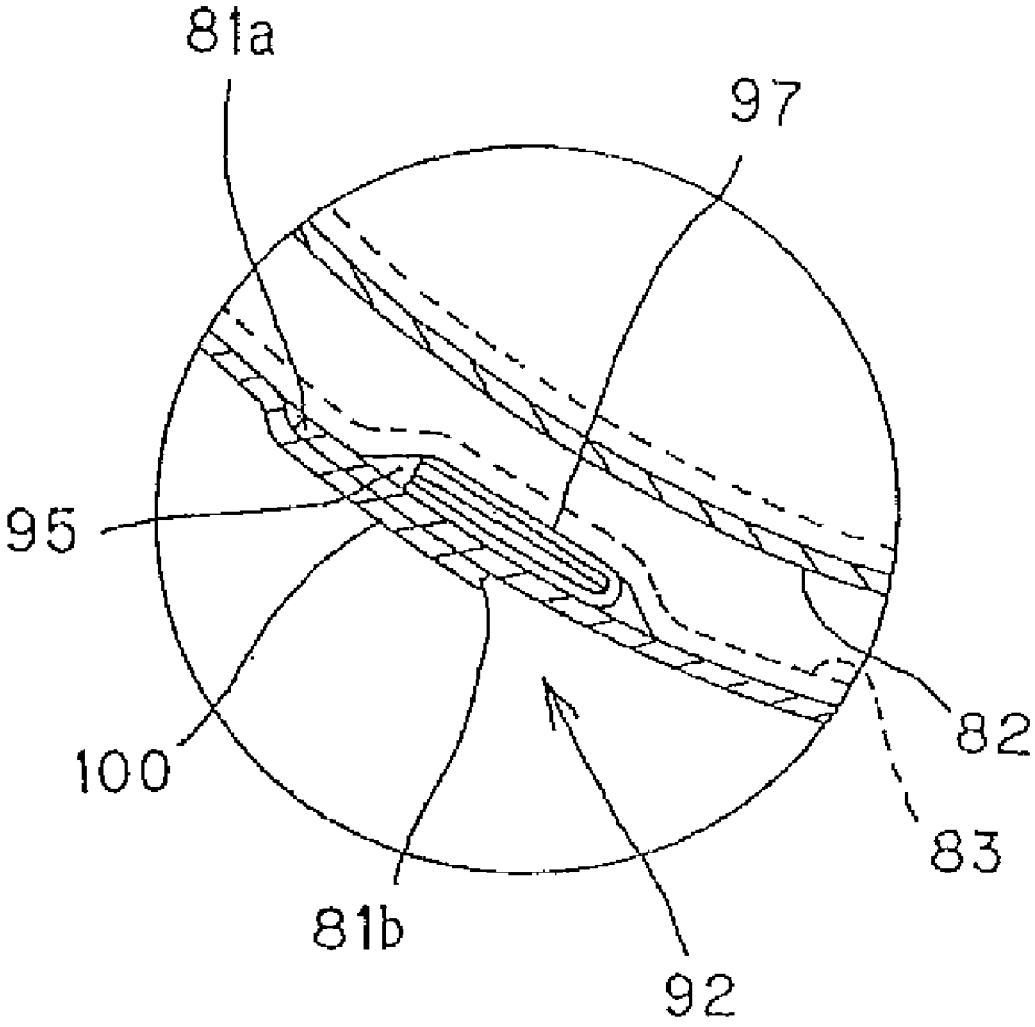
FIG. 7 is an enlarged sectional view of a portion denoted by reference character C in FIG. 5.

FIG. 7 is an enlarged view of the portion C shown in FIG. 5.

As is apparent from FIG. 7, the overlapping portion 100 of the sheet metal 81 forming the outer cylinder 80 is formed by overlapping the opposite end portions of the sheet metal 81. More specifically, one end 81*a* of the sheet metal 81 is located radially inside of the other end 81*b* of the sheet metal 81. The other end 81*b* of the sheet metal 81 is welded to the end portion of the sheet metal 81 near the one end 81*a*, thereby forming the substantially cylindrical shape of the outer cylinder 80. The first separator 83 is accommodated in the outer cylinder 80 in such a manner that the center of the recess 95 is positioned directly under (radially inside) the other end 81*b* of the sheet metal 81. Thus, the recess 95 is located directly under the welded portion 92, so that the welded portion 92 is spaced apart from the large-diameter portion 83*d* of the first separator 83 at the position of the recess 95. Accordingly, it is possible to prevent the outer cylinder 80 from being welded to the first separator 83.

The depth of the recess 95 is set slightly larger than the thickness of the overlapping portion 100 of the sheet metal 81 forming the outer cylinder 80, wherein the thickness of the overlapping portion 100 is equal to the sum of the thickness of the one end 81*a* of the sheet metal 81 and the thickness of the other end 81*b* of the sheet metal 81. The overlap width of the overlapping portion 100 is equal to the length of the recess 95 in the circumferential direction of the first separator 83.

In positioning the recess 95 directly under the welded portion 92, the recess 95 can be used as an alignment mark, thereby facilitating the alignment of the recess 95 and the welded portion 92. Further, the recess 95 may be used for aligning with a welding jig or the like, thereby facilitating the alignment.

As shown in FIG. 7, a plug member 97 is provided in the space defined by the recess 95 of the first separator 83 and the outer cylinder 80. The plug member 97 is formed of the same material (e.g., stainless steel) as that of the inner cylinder 82, and it has a mesh structure. Preferably, the size of the plug member 97 is substantially the same as that of the recess 95 so as to fill the recess 95. Thus, the recess 95 of the first separator 83 is filled with the plug member 97. Accordingly, the plug member 97 can prevent the sound insulating material 91 from scattering from the recess 95.

The plug member 97 is located directly under the welded portion 92. Accordingly, the plug member 97 also functions to prevent direct contact of heat and melt with the first separator 83 in welding the overlapping portion 100 of the sheet metal 81 to form the outer cylinder 80. Thus, the outer cylinder 80 is prevented from being welded to the first separator 83. The plug member 97 is set in the recess 95 prior to wrapping the sheet metal 81 around the subassembly 90.

The first separator 83 is mounted inside the outer cylinder 80 in such a manner that the outer circumferential surface of the large-diameter portion 83*d* of the first separator 83 is fitted with the inner circumferential surface of the outer cylinder 80. Furthermore, the first exhaust pipe 87 and the third exhaust pipe 89 are not welded to the first separator 83. Further, in welding the overlapping portion 100 of the sheet metal 81 to form the outer cylinder 80, the welded portion 92 is spaced apart from the recess 95 formed on the large-diameter portion 83*d* of the first separator 83. Accordingly, the outer cylinder 80 is prevented from being welded to the first separator 83. After the sheet metal 81 is wrapped around the subassembly 90 having the first separator 83, the overlapping portion 100 of the sheet metal 81 is welded to form the outer cylinder 80. In this condition, however, the first separator 83 is movable in the outer cylinder 80. Accordingly, in the case where the temperature in the inside space of the muffler 24 becomes high and the amount of expansion of the inner cylinder 82 becomes larger than that of the outer cylinder 80, the inner cylinder 82 can extend together with the first separator 83 in the axial direction of the muffler 24, thereby absorbing strain due to the thermal expansion.

Further, since the outer cylinder 80 is formed by first wrapping the sheet metal 81 around the subassembly 90 and next welding the overlapping portion 100 of the sheet metal 81. Thus, a step of inserting the subassembly 90 into the outer cylinder 80 can be eliminated. Accordingly, it is not necessary to remove a weld residue on the inner surface of the outer cylinder 80 prior to insertion of the subassembly 90 into the outer cylinder 80.

According to the first preferred embodiment of the present invention mentioned above, the inner cylinder 82, the first separator 83, and the second separator 84 are assembled to obtain the subassembly 90. The sheet metal 81 is wrapped around the subassembly 90, and the overlapping portion 100 of the sheet metal 81 is welded to form the outer cylinder 80. The large-diameter portion 83*d* of the first separator 83 has the recess 95, and the welded portion 92 of the outer cylinder 80 is aligned to the recess 95 of the first separator 83. Accordingly, the welded portion 92 of the outer cylinder 80 is spaced apart from the recess 95 of the first separator 83, so that the outer cylinder 80 is prevented from being welded to the large-diameter portion 83*d* of the first separator 83. Accordingly, in welding the overlapping portion 100 of the sheet metal 81 to form the outer cylinder 80, the subassembly 90 is prevented from being welded to the outer cylinder 80. Thus, although the outer cylinder 80 is formed by first wrapping the sheet metal 81 around the subassembly 90 and next welding the overlapping portion 100 of the sheet metal 81, the first separator 83 can be moved in the outer cylinder 80, thereby absorbing the extension of the inner cylinder 82 due to thermal expansion.

The space defined by the recess 95 of the first separator 83 and the outer cylinder 80 is filled with the plug member 97. Accordingly, it is possible to prevent the sound insulating material 91 such as glass wool filled in the annular space between the outer cylinder 80 and the inner cylinder 82 from being scatter from the above space between the recess 95 of the first separator 83 and the outer cylinder 80.

Figure 8:
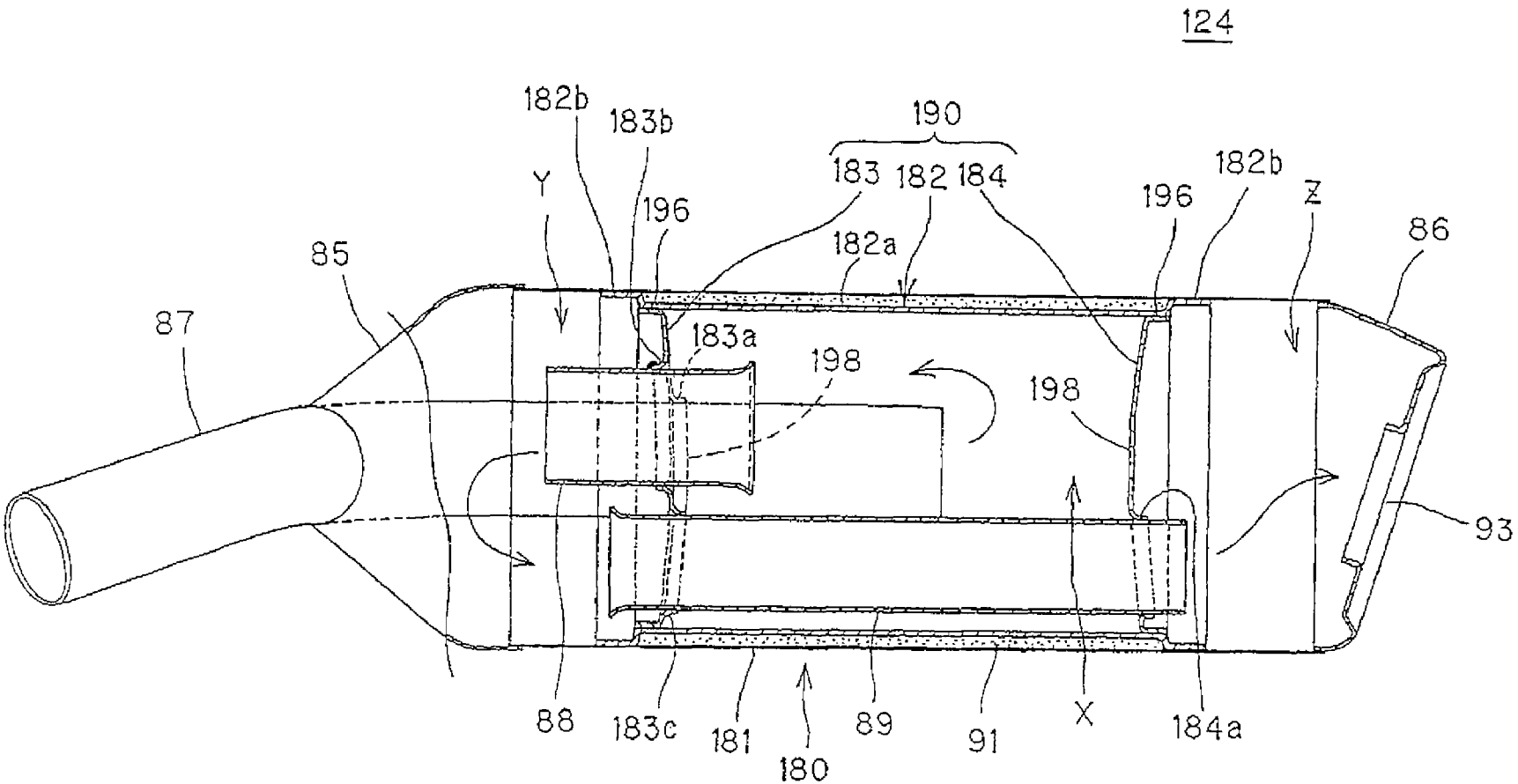
FIG. 8 is a partially sectional side view of a muffler according to a second preferred embodiment of the present invention.
Figure 9:
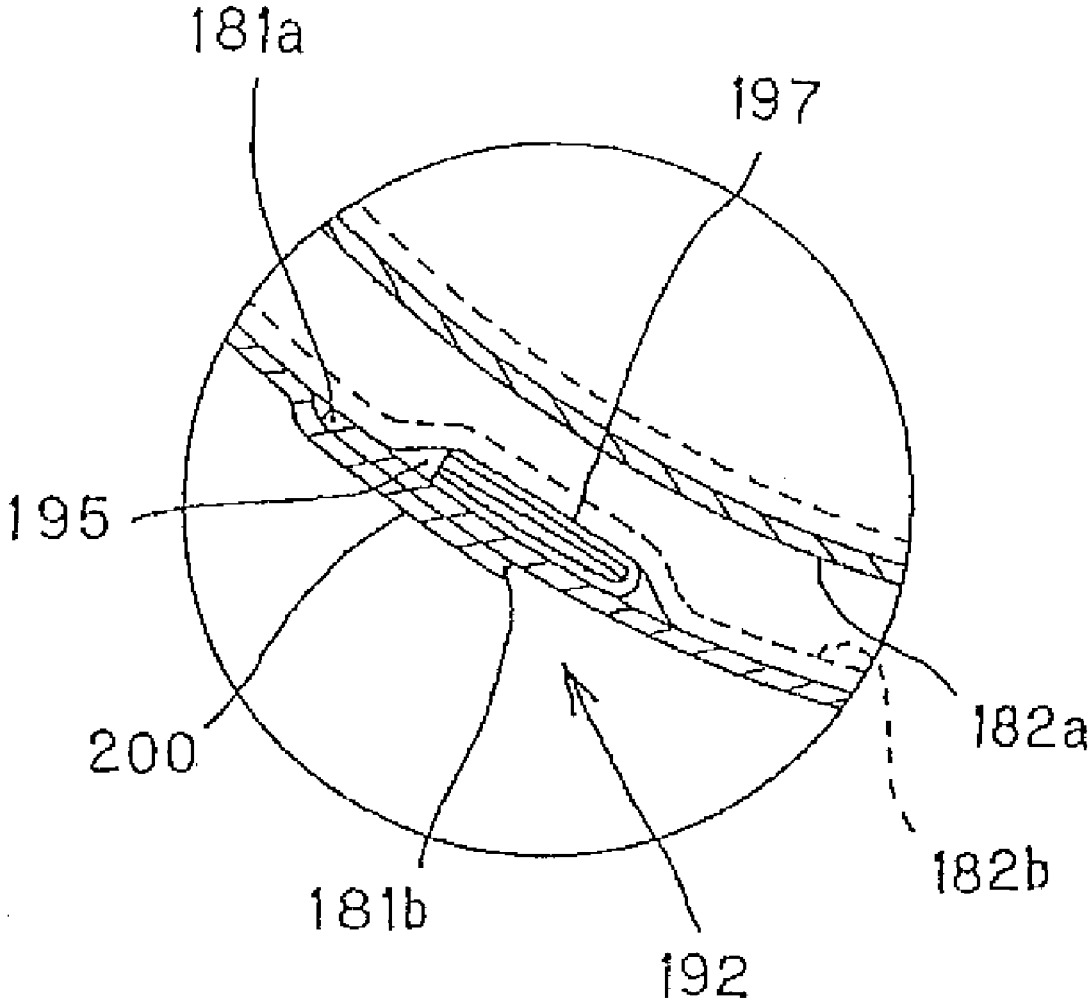
FIG. 9 is an enlarged sectional view of an essential part of the muffler shown in FIG. 8.

FIG. 8 is a partially sectional side view of a muffler 124 according to a second preferred embodiment of the present invention, and FIG. 9 is an enlarged sectional view similar to FIG. 7, showing an essential part of the muffler 124.

In the following description of the second preferred embodiment, substantially the same parts as those of the muffler 24 according to the first preferred embodiment are denoted by the same reference numerals and the description thereof will be omitted herein.

As shown in FIG. 8, the muffler 124 includes a subassembly 190. The subassembly 190 is composed of an inner cylinder 182, a first separator 183 mounted near the front end of the inner cylinder 182, and a second separator 184 mounted near the rear end of the inner cylinder 182. The inner cylinder 182 is composed of a central cylindrical portion 182*a* and a pair of flange portions 182*b* formed at the opposite ends of the cylindrical portion 182*a*. The first and second separators 183 and 184 are welded to the opposite ends of the cylindrical portion 182*a* of the inner cylinder 182, thus forming the subassembly 190.

A sheet metal 181 is wrapped around the flange portions 182*b* of the inner cylinder 182 of the subassembly 190 to thereby form the substantially cylindrical shape of an outer cylinder 180. An overlapping portion 200 of the sheet metal 181 is welded over the length thereof substantially parallel to the axial direction of the outer cylinder 180, thus obtaining the outer cylinder 180 surrounding the subassembly 190. A sound insulating material 191 such as glass wool is filled in the annular space between the outer cylinder 180 and the inner cylinder 182.

Each of the first and second separators 183 and 184 is a substantially pan-shaped member having an outer circumferential portion 196 and a substantially dish-shaped bottom portion 198. The outer diameter of the outer circumferential portion 196 is substantially the same as the inner diameter of the cylindrical portion 182*a* of the inner cylinder 182. The subassembly 190 is formed in such a manner that the outer circumferential portions 196 of the first and second separators 183 and 184 are fitted to the opposite ends of the cylindrical portion 182*a* of the inner cylinder 182 and that the bottom portions 198 of the first and second separators 183 and 184 are opposed to each other. In this condition, the outer circumferential portions 196 are welded to the cylindrical portions 182*a* of the inner cylinder 182.

The first separator 183 is formed with a hole 183*a* for insertion of a first exhaust pipe 87, a hole 183*b* separate from the hole 183*a* for insertion of a second exhaust pipe 88, and a hole 183*c* separate from the holes 183*a* and 183*b* for insertion of a third exhaust pipe 89. The second separator 184 is formed with a hole 184*a* for insertion of the third exhaust pipe 89. The first exhaust pipe 87 is inserted through the hole 183*a* of the first separator 183 to communicate with the first expansion chamber X. The second exhaust pipe 88 is inserted through the hole 183*b* of the first separator 183 to make the communication between the first expansion chamber X and the second expansion chamber Y. The third exhaust pipe 89 is inserted through the hole 183*c* of the first separator 183 and the hole 184*a* of the second separator 184 to make the communication between the second expansion chamber Y and the third expansion chamber Z.

With this structure, the exhaust gas from the engine 5 is first passed through the first exhaust pipe 87 to enter the first expansion chamber X. Thereafter, the direction of flow of the exhaust gas is reversed and the exhaust gas is passed through the second exhaust pipe 88 to enter the second expansion chamber Y. Thereafter, the direction of flow of the exhaust gas is reversed again and the exhaust gas is passed through the third exhaust pipe 89 to enter the third expansion chamber Z. Finally, the exhaust gas is discharged from the exhaust hole 93 of the end cap 86.

The rear flange portion 182*b* of the inner cylinder 182 is plug-welded to the outer cylinder 180, but the front flange portion 182*b* of the inner cylinder 182 is not welded to the outer cylinder 180. The front flange portion 182*b* of the inner cylinder 182 is formed with a recess 195 located directly under a welded portion 192 formed by welding the overlapping portion 200 of the sheet metal 181. Accordingly, the overlapping portion 200 is spaced apart from the front flange portion 182*b* at the position of the recess 195, thereby reliably preventing the front flange portion 182*b* from being welded to the outer cylinder 180 in welding the overlapping portion 200.

Further, a plug member 197 having a mesh structure is provided in the recess 195 to thereby fill the space defined by the outer cylinder 180 and the recess 195 of the inner cylinder 182. Accordingly, scattering of the sound insulating material 91 from the recess 195 can be prevented. The plug member 197 may be formed of the same material (e.g., stainless steel) as that of the inner cylinder 182.

According to the second preferred embodiment, the front flange portion 182*b* of the inner cylinder 182 is reliably prevented from being welded to the outer cylinder 180 in welding the overlapping portion 200 of the sheet metal 181 forming the outer cylinder 180. Accordingly, as in the first preferred embodiment, it is possible to prevent that the subassembly 190 accommodated in the outer cylinder 180 may be welded to the outer cylinder 180 in welding the overlapping portion 200 of the sheet metal 181. Further, since the space defined between the recess 195 of the inner cylinder 182 and the outer cylinder 180 is filled with the plug member 197, scattering of the sound insulating material 91 can be prevented.

It should be noted that the above preferred embodiments are merely illustrative and that the present invention is not limited to the above preferred embodiments. For example, while the inside space of the muffler 24 is separated by the first and second separators 83 and 84 in the first preferred embodiment, the inner cylinder 82 may be divided and a third separator may be added to configure the subassembly 90, wherein two of the separators may be movable in the outer cylinder 80.

While the plug member 97 is formed of stainless steel and has a mesh structure in the first preferred embodiment, the material and structure of the plug member 97 are not limited provided that it is not readily deteriorated and melted in welding the outer cylinder 80.

While the present invention is applied to a saddle seat type four-wheel vehicle in the above preferred embodiments, the present invention is applicable to various kinds of vehicles including a motorcycle.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A muffler structure comprising:

a subassembly formed by fixing an inner cylinder and a separator; and an outer cylinder for supporting said subassembly so as to accommodate said subassembly;

wherein said outer cylinder is formed by first wrapping a sheet metal around said subassembly and next welding an overlapping portion of said sheet metal; and said subassembly is formed with a recess opposed to a welded portion of said outer cylinder.

2. The muffler structure according to claim 1, wherein said separator has an outer diameter substantially equal to the inner diameter of said outer cylinder, and said recess is formed on the outer circumferential surface of said separator.

3. The muffler structure according to claim 1, wherein said inner cylinder has a flange portion having an outer diameter substantially equal to the inner diameter of said outer cylinder, and said recess is formed on the outer circumferential surface of said flange portion.

4. The muffler structure according to claim 1, wherein a sound insulating material is provided between said outer cylinder and said inner cylinder, and the space defined by said recess and said outer cylinder is filled with a plug member.

5. The muffler structure according to claim 2, wherein a sound insulating material is provided between said outer cylinder and said inner cylinder, and the space defined by said recess and said outer cylinder is filled with a plug member.

6. The muffler structure according to claim 3, wherein a sound insulating material is provided between said outer cylinder and said inner cylinder, and the space defined by said recess and said outer cylinder is filled with a plug member.

7. The muffler structure according to claim 1, wherein the separator includes an outer circumferential surface of a large diameter portion with the recess being formed at a position radially inside of the welded portion.

8. The muffler structure according to claim 7, wherein the recess includes a bottom surface that is substantially flat.

9. The muffler structure according to claim 1, wherein the overlapping portion of the sheet metal includes a first end located radially inside of a second end with the second end being welded to the end portion of the sheet metal near to the first end for forming a substantially cylindrical shape.

10. The muffler structure according to claim 9, wherein the recess is located directly under the welded portion wherein the welded portion is spaced apart from a larger diameter portion of the separator at the position of the recess for preventing the outer cylinder from being welded to the separator.

11. A muffler structure comprising:

a subassembly formed by fixing an inner cylinder and a separator;

an outer cylinder formed by first wrapping a sheet metal around said subassembly and next welding an overlapping portion of said sheet metal; and a recess formed in said subassembly for being opposed to a welded portion of said outer cylinder.

12. The muffler structure according to claim 11, wherein said separator has an outer diameter substantially equal to the inner diameter of said outer cylinder, and said recess is formed on the outer circumferential surface of said separator.

13. The muffler structure according to claim 11, wherein said inner cylinder has a flange portion having an outer diameter substantially equal to the inner diameter of said outer cylinder, and said recess is formed on the outer circumferential surface of said flange portion.

14. The muffler structure according to claim 11, wherein a sound insulating material is provided between said outer cylinder and said inner cylinder, and the space defined by said recess and said outer cylinder is filled with a plug member.

15. The muffler structure according to claim 12, wherein a sound insulating material is provided between said outer cylinder and said inner cylinder, and the space defined by said recess and said outer cylinder is filled with a plug member.

16. The muffler structure according to claim 13, wherein a sound insulating material is provided between said outer cylinder and said inner cylinder, and the space defined by said recess and said outer cylinder is filled with a plug member.

17. The muffler structure according to claim 11, wherein the separator includes an outer circumferential surface of a large diameter portion with the recess being formed at a position radially inside of the welded portion.

18. The muffler structure according to claim 17, wherein the recess includes a bottom surface that is substantially flat.

19. The muffler structure according to claim 11, wherein the overlapping portion of the sheet metal includes a first end located radially inside of a second end with the second end being welded to the end portion of the sheet metal near to the first end for forming a substantially cylindrical shape.

20. The muffler structure according to claim 19, wherein the recess is located directly under the welded portion wherein the welded portion is spaced apart from a larger diameter portion of the separator at the position of the recess for preventing the outer cylinder from being welded to the separator.

* * * * *